US006069540A

United States Patent [19]

Berenz et al.

[11] Patent Number: 6,069,540

[45] Date of Patent: May 30, 2000

[54] MICRO-ELECTRO SYSTEM (MEMS) SWITCH

[75] Inventors: John J. Berenz, San Pedro; George W. McIver, Redondo Beach; Alfred E. Lee, Torrance, all of Calif.

[73] Assignee: TRW Inc., Redondo Reach, Calif.

[21] Appl. No.: 09/418,341

[22] Filed: Oct. 14, 1999

Related U.S. Application Data

[63] Continuation of application No. 08/897,075, Apr. 23, 1999, abandoned.

[51] Int. Cl.[7] ..... H01P 1/10; H01H 57/00

[52] U.S. Cl. ..... 333/101; 200/181; 333/105

[58] Field of Search ..... 333/101, 105–107, 333/262; 200/181, 339

[56] References Cited

U.S. PATENT DOCUMENTS 4,203,017 5/1980 Lee ..... 200/339
5,638,946 6/1997 Zavracky ..... 200/181

FOREIGN PATENT DOCUMENTS 08235997 9/1996 Japan .

*Primary Examiner*—Paul Gensler
*Attorney, Agent, or Firm*—Michael S. Yatsko

[57] ABSTRACT

An RF switch formed as a micro electro-mechanical switch (MEMS) which can be configured in an array forming a micro electro-mechanical switch array (MEMSA). The MEMS is formed on a substrate. A pin, pivotally carried by the substrate defines a pivot point. A rigid beam or transmission line is generally centrally disposed on the pin forming a teeter-totter configuration. The use of a rigid beam and the configuration eliminates the torsional and bending forces of the beam which can reduce reliability. The switch is adapted to be monolithically integrated with other monolithic microwave integrated circuits (MMIC) for example from HBTs and HEMTs, by separating such MMICs from the switch by way of a suitable polymer layer, such as polyimide, enabling the switch to be monolithically integrated with other circuitry. In order to reduce insertion losses, the beam is formed from all metal, which improves the sensitivity of the switch and also allows the switch to be used in RF switching applications. By forming the beam from all metal, the switch will have lower insertion loss than other switches which use SiO2 or mix metal contacts.

22 Claims, 14 Drawing Sheets

MICRO-ELECTRO SYSTEM (MEMS) SWITCH

CROSS REFERENCE TO RELATED APPLICATIONS

This is a continuation of prior application number 08/897,075, filed Apr. 23, 1999, now abandoned, which is hereby incorporated herein by reference in its entirety.

This application is related to a patent application entitled MEMS Switch Resonators for VCO Applications, by Mark Kintis and John Berenz, filed on Jul. 18, 1997, now U.S. Pat. No. 5,994,982.

BACKGROUND OF THE INVENTION

Field of the Invention

The present invention relates to an RF switch and more particularly an RF switch formed as a monolithically integrated micro electro-mechanical system (MEMS) switch, which includes a rigid beam, a substrate and one or more electrical contacts, monolithically formed with a metal pin pivotally coupled to a substrate, defining a pivot point for the beam forming a teeter-totter that is adapted to be electrostatically actuated to pivot between a contact open position and a contact closed position, which eliminates the flexing of the beam thereby increasing the switch life. 2. Description of the Prior Art RF switches are generally known in the art. Examples of such switches are described in detail in U.S. Pat. No. 5,578,976, hereby incorporated by reference. Such RF switches are used in various microwave and millimeter applications, such as tunable preselectors, frequency synthesizers as well as automotive applications.

FIG. 1 is illustrative of a known RF micro electro-mechanical system (MEMS) switch. As shown, the MEMS, generally identified with the reference numeral 20, is formed on a substrate 22, with a post 24 formed at one end. A flexible cantilever beam 26 is connected on one end to the post 24. The cantilever beam 26 is adapted to carry an electrical contact 28 on one end that is aligned and adapted to mate with a corresponding contact 29 carried by the substrate 22. An RF input signal is adapted to be connected to the contact 29 which forms an RF input port, while the contact 28 forms an RF output port.

The switch 20 is adapted to be actuated electrostatically. A grounding plate 32 is formed on the substrate 22 while a field plate 34 is formed on the cantilever beam 26. The grounding plate 32 is adapted to be connected to ground while the field plate 34 is adapted to be selectively coupled to a DC voltage source. In operation, in an off state with no voltage applied to the field plate 34, the contact 28 is separated from the contact 29 defining a contact open state, as generally shown in FIG. 1. When an appropriate DC voltage is applied to the field plate 34, the cantilever beam 34 is deflected by the electrostatic forces, causing the electrical contact 28 to mate with the electrical contact 29 allowing the RF input signal to be electrically connected to the RF output port. When the voltage is removed from the field plate 34, the cantilever arm 20 returns to its static position as shown in FIG. 1 due to the restoring forces in the cantilever beam 26.

U.S. Pat. No. 5,552,924 also discloses a micro electro-mechanical (MEM) device formed on a substrate. A post is formed on the substrate for supporting an elongated beam. The elongated beam is center supported and formed with electrical contact on opposing ends. The structure operates electrostatically. More particularly, a DC voltage applied to field plates on the elongated beam result in electrostic forces which cause torsional bending of the beam.

Unfortunately, the configurations discussed above require bending of the cantilever beam everytime the switch operates. Such bending results in reduced switch reliability as well as reduced switch life.

There are other problems associated with such known RF switches, such as relatively high insertion losses, unacceptable in certain applications, such as RF switching applications. More particularly, the cantilever beam, disclosed in U.S. Pat. No. 5,578,976 is formed from silicon dioxide $SiO_2$ while a composite silicon metal alloy (Al:Ti:Si) is used for the beam in the switch disclosed in U.S. Pat. No. 5,552,994. Unfortunately, the use of such materials for the beam results in a relatively high insertion loss and thus results in reduced sensitivity of the RF switch.

As mentioned above, such RF switches are adapted to be utilized in a wide range of applications, such as frequency synthesizers and the like. Conventional semiconductor RF switches are known to be relatively large and bulky (i.e. 400 $in^3$ for a 16×16 array) making packaging sizes for systems utilizing such RF switches relatively large. As such, micro-machined RF switches have been developed, for example as disclosed in U.S. Pat. Nos. 5,578,976 and 5,552,994. Such micro-machined RF switches have significantly reduced package sizes (i.e. 1 $in^3$). However, known fabrication techniques for such micro-machined RF switches are incompatible with known HBT and HEMT or CMOS processing techniques, heretofore preventing integration of said RF switches with such HEMT and HBT or CMOS devices.

SUMMARY OF THE INVENTION

It is an object of the present invention to solve various problems in the prior art.

It is yet another object of the present invention to provide an RF switch adapted to be fabricated by known electroforming techniques.

It is yet another object of the present invention to provide an RF switch which provides improved mechanical reliability relative to known RF switches.

It is yet another object of the present invention to provide RF switch that is adapted to be monolithically integrated with other integrated circuitry, such as CMOS, HBT and HEMT microwave monolithic integrated circuits (MMIC).

Briefly, the present invention relates to an RF switch formed as a micro electro-mechanical system (MEMS) which can be configured in an array forming a micro electro-mechanical switch array (MEMSA). The MEMS is formed on a substrate. A pin pivotally carried by the substrate defines a pivot point. A rigid beam or transmission line is generally centrally disposed on the pin forming a teeter-totter configuration. The use of a rigid beam eliminates the torsional and bending forces of the beam which can reduce reliability. The switch is adapted to be monolithically integrated with MMICs formed, for example, from HBTs and HEMTs by separating such circuits from the switch by way of a suitable polymer layer, such as polyimide, for protecting the MMIC during the fabrication process of the RF switch. In order to reduce insertion losses, the beam is formed from all metal, which improves the sensitivity of the switch and also allows the switch to be used in RF switching applications. By forming the beam or transmission line from all metal, the switch will have lower insertion loss than other switches which use $SiO_2$ composite silicon metal beams.

DESCRIPTION OF THE DRAWINGS

These and other objects of the present invention will be readily understood with reference to the following specification and attached drawings wherein.

DETAILED DESCRIPTION

The present invention relates to an RF switch adapted to be fabricated by known electroforming techniques as a micro electro-mechanical system (MEMS) switch which can be formed in an array to create a micro electro-mechanical switch array (MEMSA). As will be discussed in more detail below, the switch is configured to provide increased mechanical reliability as well as increased switch life. In addition, the switch is adapted to be formed on a polymer layer or substrate which can be used to protect a microwave monolithic integrated circuit (MMIC) to enable the switch to be integrated therewith.

Figure 1:
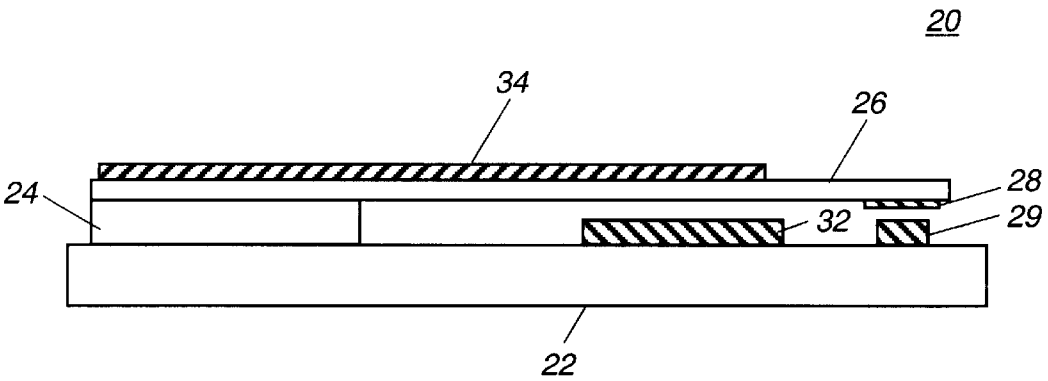
Fig. 1 Prior Art
FIG. 1 is an elevational view of a known RF switch.
Figure 2:
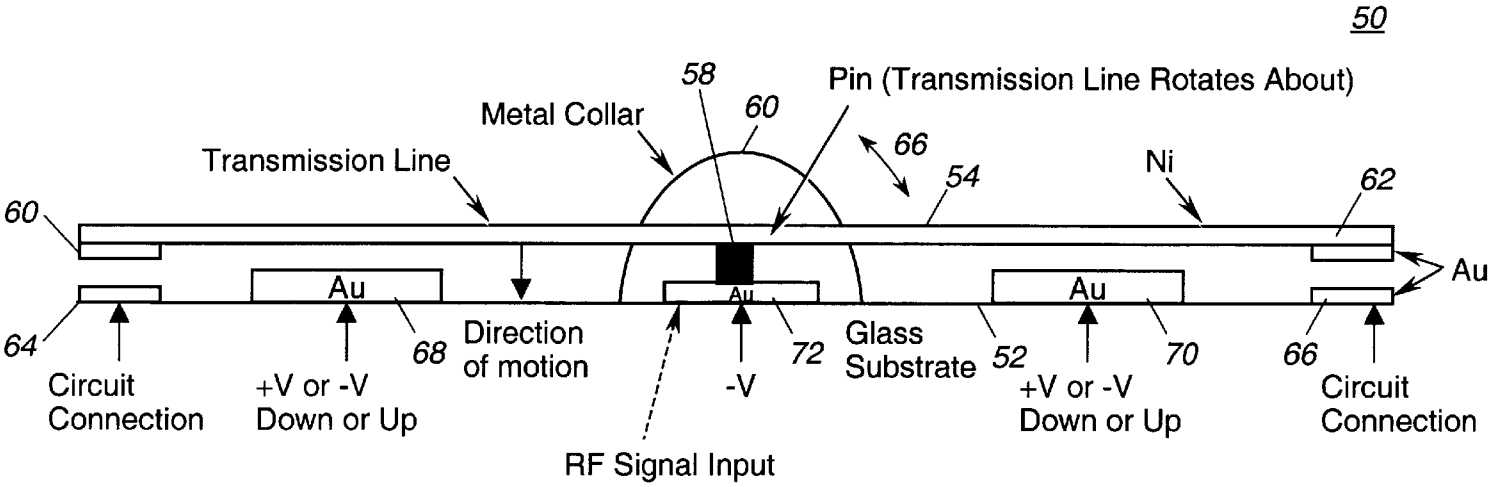
FIG. 2 is an elevational view of an RF switch in accordance with the present invention.
Figure 3A:
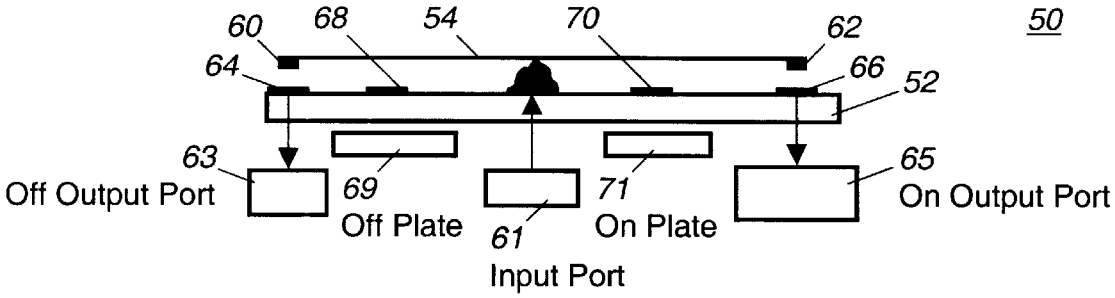
FIG. 3*a* is similar to FIG. 2 further illustrating field plates.
Figure 3B:
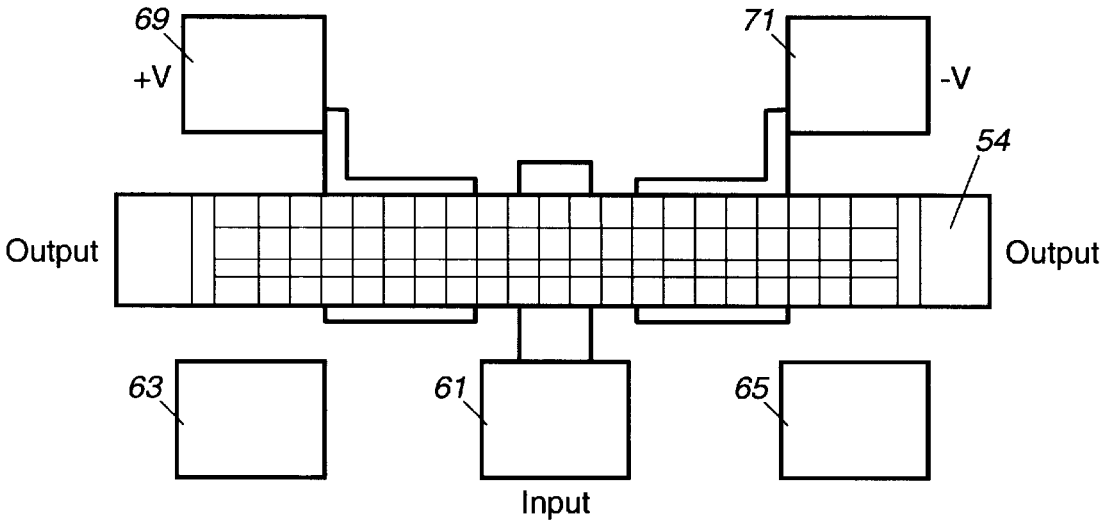
FIG. 3*b* is a plan view of the RF switch illustrated in FIGS. 2 and 3*a*.

One embodiment of the RF switch in accordance with the present invention is illustrated in FIGS. 2, 3*a* and 3*b* and generally identified with the reference numeral 50. The switch 50 is adapted to be formed on a substrate 52. In applications where the switch 50 is to be integrated with a microwave monolithic integrated circuit (MMIC), such as HEMT distributed amplifiers and HBT TTL drive circuits, the substrate 52 is formed from a polymer, such as polyimide, i.e. BPDA-PDA Dupont p-phenylene biphenyl tetra carboximidide. The polymer is formed as a layer directly on top of the MMIC to protect the MMIC during the fabrication process of the RF switch. The low dielectric constant of the polyimide (i.e. $\epsilon$=2), for example, provides for a relatively low loss substrate for the RF transmission line.

Figure 4:
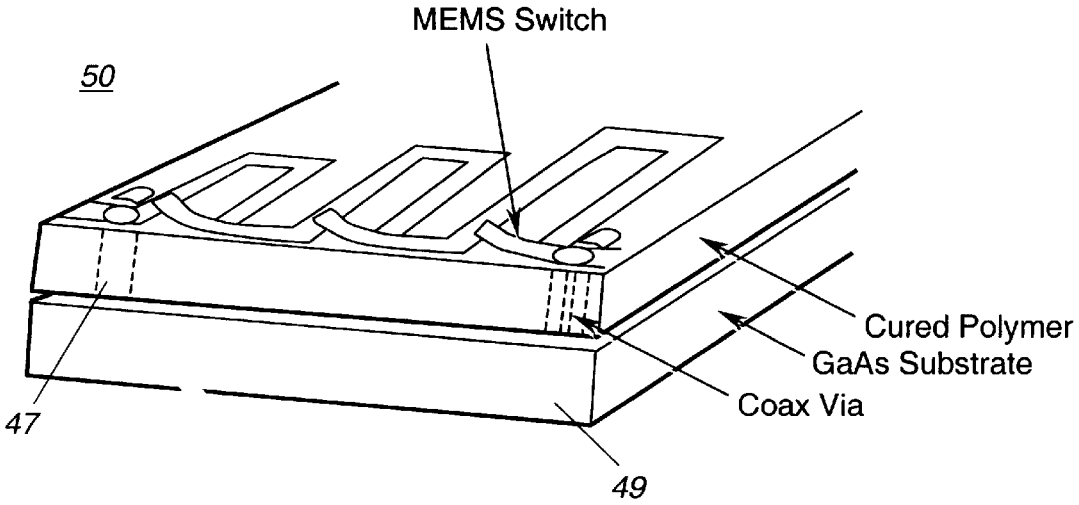
FIG. 4 is a perspective view illustrating the RF switch in accordance with the present invention fabricated on a MMIC.

As best shown in FIG. 4, interconnections between the switch 50 and the MMIC 49 may be provided by coaxial via holes 47, which allow transition from one level to another while preserving RF impedance and providing high isolation.

An important aspect of the invention relates to the fact that the beam 54 is rigid and. is adapted to rotate about a pin 58 (FIG. 2). The pin 58 is pivotally mounted relative to the substrate 52, for example, by metal collars 60 forming a teeter-totter configuration. By eliminating the bending or torsional flexing of the beam 54, fatigue of the beam is reduced thus, improving the overall reliability of the switch as well as the switch life.

Various configurations of the RF switch in accordance with the present invention are contemplated; for example, FIGS. 3*a* and 3*b* illustrate a single pole double throw switch configuration. However, the principals of the present invention are applicable to other switch configuration as well. The single pole double throw switch 50 is formed with metal contacts 59 and 62, for example, gold Au, formed on the side of the beam 54 facing the substrate 52. These contacts 59 and 62 are adapted to mate with corresponding contacts 64 and 66, respectively, formed on the substrate 52.

The RF switch 50 is adapted to be actuated by electrostatic forces. In particular, a pair of electrical contacts 68, 70 may be formed on the substrate 52. The making and breaking of these contacts 68 and 70 is under the control of electrostatic forces generated as a result of appropriate DC voltages being applied to corresponding field plates 69 and 71 (FIG. 3*a*). In particular, the combination of the field plates 69 and 71 with the contacts 68 and 71 form parallel plate capacitors. Thus, application of DC potential to the field plates 69 and 71 will result in electrostatic attraction and repulsion forces between the contacts 68 and 70 and the metal beam 54. The direction of rotation of the beam 54 will be dependent upon the polarity of the DC voltage applied to the field plates 69 and 71. For the single pole double throw switch 50, a contact 72 may be formed on the substrate 52, which, in turn, is in electrical contact with the pin 58 and the beam 54, which are formed from electrical conductive materials (i.e. nickel). The contact 72 may be used as an RF input port 61 (FIG. 3*a*), while the contact pairs 59, 64 and 62, 66 are used as RF output ports 63 and 65, respectively. In particular, when the contact 62 is in electrical contact with the electrical contact 66, the RF input signal applied to the contact 72 is directed out of the electrical contacts 62 and 66. Alternatively, when the contact 60 is in electrical contact with the contact 64, the RF input signal is directed out of the contacts 59 and 64.

In order to reduce the insertion losses as well as improve the sensitivity of the switch, the beam 54 may be formed from all metal. In particular, the beam 54 may be formed from electroplated nickel Ni at low temperatures compared to most semiconductor processing. Not only does an all metal beam 54 reduce insertion losses relative to known SiO2 or composite silicon metal beams, such a configuration also improves the third order intercept point for providing increased dynamic range.

Figure 5A:
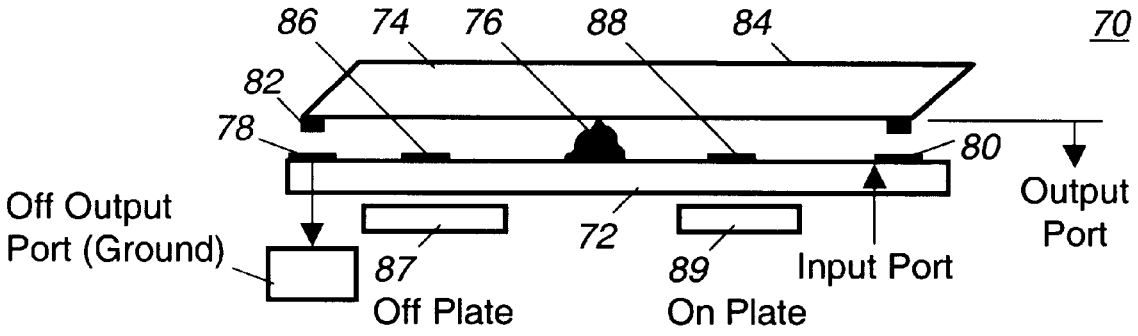
FIG. 5*a* is an elevational view of an alternate embodiment of the RF switch in accordance with the present invention.
Figure 5B:
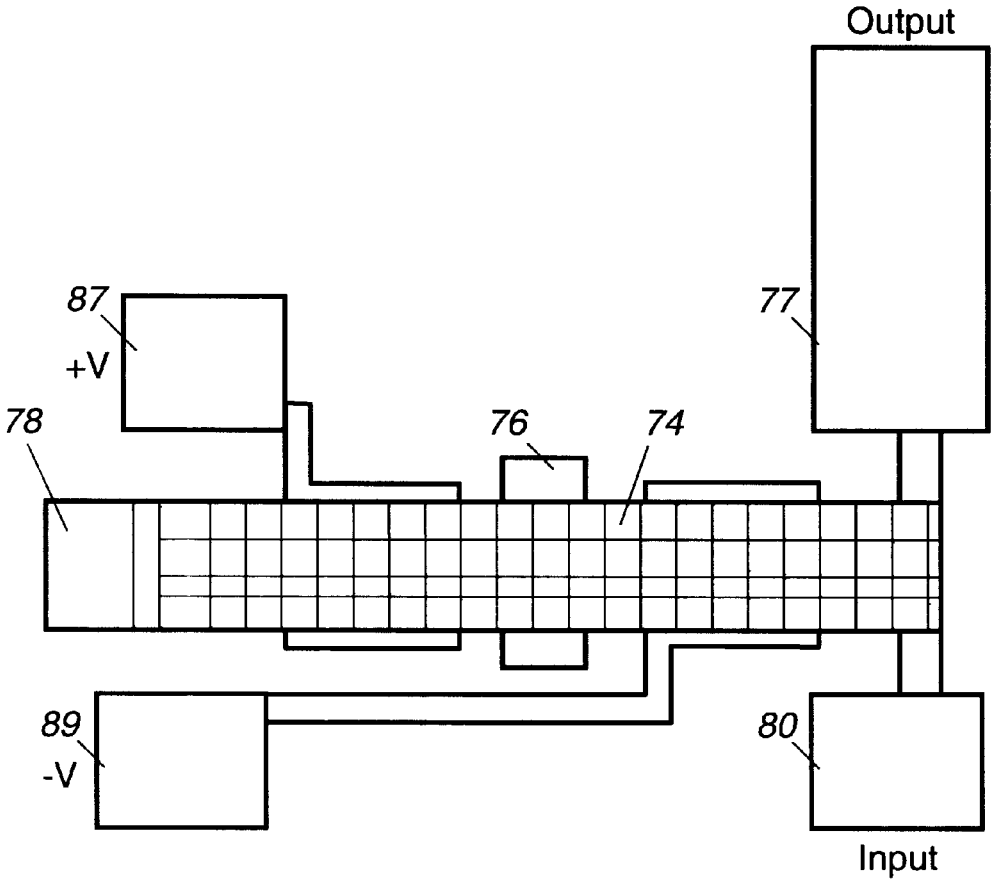
FIG. 5*b* is a plan view of the RF switch illustrated in FIG. 5*a*.

In the switch configuration illustrated in FIGS. 2, 3*a* and 3*b*, the pin 58 forms an RF input port. In FIGS. 5*a* and 5*b*, an alternate configuration is shown in which the RF switch, generally identified with the reference numeral 70, includes a substrate 72, a beam 74 and a pin 76. In this embodiment, electrical contacts 78 and 80 are formed on each end of the substrate 72 and adapted to mate with corresponding contacts 82 and 84, respectively, formed on opposing ends of the beam 74. In the latter configuration, the contact 80, formed on one end of the substrate 76, forms an RF input port, while a contact 77 electrically coupled to the beam 74 forms an RF output port.

Electrostatic forces are used to rotate the beam 74 as discussed above. In particular, the contact 78 forms an off output port and is connected to ground. A pair of contacts 86 and 88 formed on the substrate 72 cooperate with a pair of field plates 87 and 89 forming parallel plate capacitors as discussed above. In particular, when the beam 74 pivots in a counter-clockwise direction, the beam 74 is grounded in order to force the electrostatic potential of the beam 74 to be zero. Otherwise unknown electrostatic forces exerted by the switch plates could cause the switch behavior to be erratic. Alternatively, when the switch 70 rotates in a clockwise direction, the beam 74 is ungrounded and the RF input port is directly connected to the beam 74 in which case contact 84 forms an output contact.

Operation of the switches 50 and 70 depend on the electrostatic forces between the beams 54 and 74 and the field plates. The force between the field plates and the beams is a function of the charge Q and the electric field E. One field plate is maintained at the same potential as the beam and hence the force is zero. The other field plate is provided with a potential difference relative to the beam 74 with a charge which is provided by equation 1:

$$Q = C \cdot V = \epsilon_0 \frac{w1}{t} V \tag{1}$$

where W is the width of the beam 1 is length of the beam, t is the contact separation and V is the voltage. The electrostatic force is given by equation 2:

$$E = V / t. \tag{2}$$

Since the electrostatic force is the product of the charge Q and the electrostatic field E, the force is provided by equation 3:

$$F = Q \cdot E = \epsilon_0 \frac{w1}{t^2} V^2 \tag{3}$$

By balancing the structure, electrostatic force is not opposed by any static or acceleration induced counter-forces. Thus, when voltage is applied to one plate, the structure tips in that direction closing the contact on the end closest to the active plate and opening the contact on the other end.

The time required for the switch to move from one position to the other is determined by the electrostatic force, the mass of the beam and the distance to be moved. Assuming that the motion of the beam is linear and the electrostatic forces are constant, even though the beam rotates about a pivot that is only about 0.006 radians and the electrostatic force varies by a factor about 2 between starting motion and full closure with a constant voltage, such an analysis provides for bounding of the switching delay by simply allowing the switching delay to be computed as if the weakest electrostatic force was applied for the full time and adding the rise time for the switching voltage. Actual switching time may be less.

Figure 11:
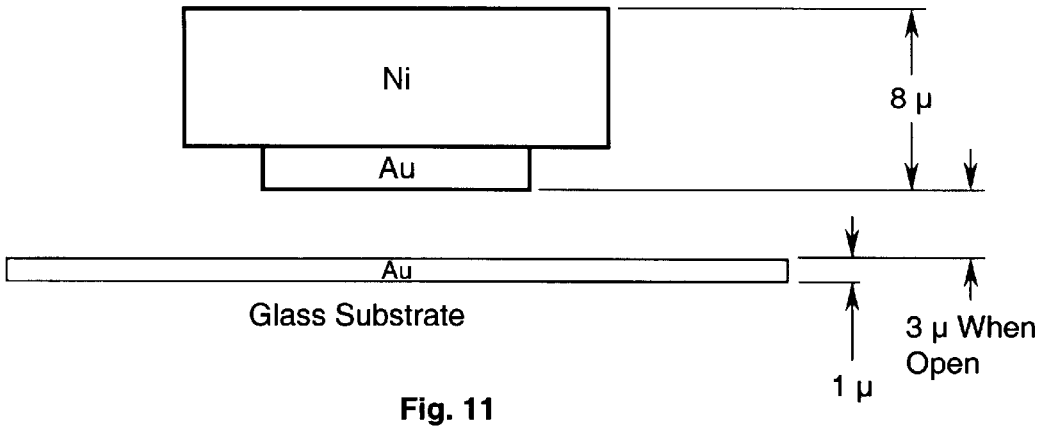
FIG. 11 is an elevational view of an exemplary contact configuration for the RF switch in accordance with the present invention.

The switching delay for the exemplary configuration illustrated in FIG. 11, is given by equation 4:

(4)

$$\sqrt{2mxF} \text{ where } m = dLwa, \text{ where} \tag{4}$$

where m=dLwa, where

X is the distance that the beam must move (i.e. three microns), d is the density of the beam (i.e. 8.9 Kg/m3), 1 is the length of the beam (i.e. 900 microns), w is the width of the beam (i.e. 150 microns), a is the thickness of the beam (i.e. 8 microns).

These exemplary values yield a mass of the beam of $9.6\times10^{-9}$ Kg. Selecting t as 4.5 microns and 1 as 200 microns with V at 10 volts, produces an electrostatic force between the beam and the plate as $1.3\times10^{-6}$ newtons, which yield a switching time of less than 200 microseconds.

For cases where higher switching speeds are required, the electrostatic force can be increased about 10 times by increasing the voltage applied to the plates from 10 to 35 volts. A factor of 3 reduction in mass is also contemplated in the mechanical design by eliminating inactive areas of the beam. The nickel thickness of the beam can also be reduced in order to optimize the switching speed. It is also contemplated that the vertical spacing could be reduced by a factor of 2 thus, increasing the electrostatic force by a factor of 4, thus decreasing the distance traveled by a factor of 2 yielding a switching time of about 2 microseconds.

The frequency response of the switch (i.e. RF operating frequency) is a function of the physical dimensions of the switch. In general, the smaller the size of the switch, the higher the frequency at which the switch can be operated due to the associated parasitics. The switch in accordance with the present invention is adapted to have minimum dimensions of approximately 10×50 microns; about 10 times small than known RF switches with an RF operating frequency of about 40 GHz.

Figure 8:
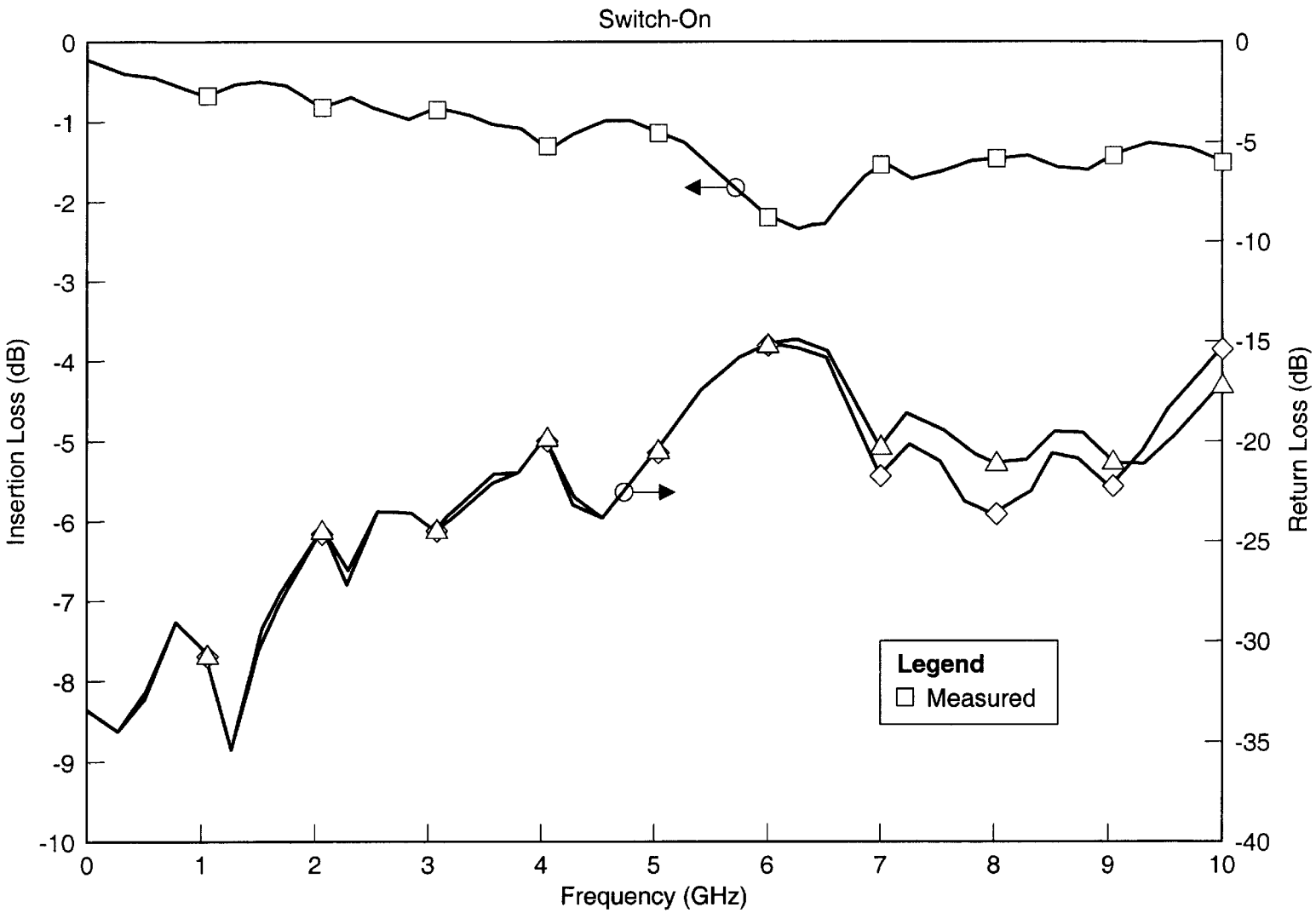
FIG. 8 is a graphical illustration of the insertion and return loss in dB as a function of frequency in GHz of an exemplary switch with the switch in an ON position.
Figure 9:
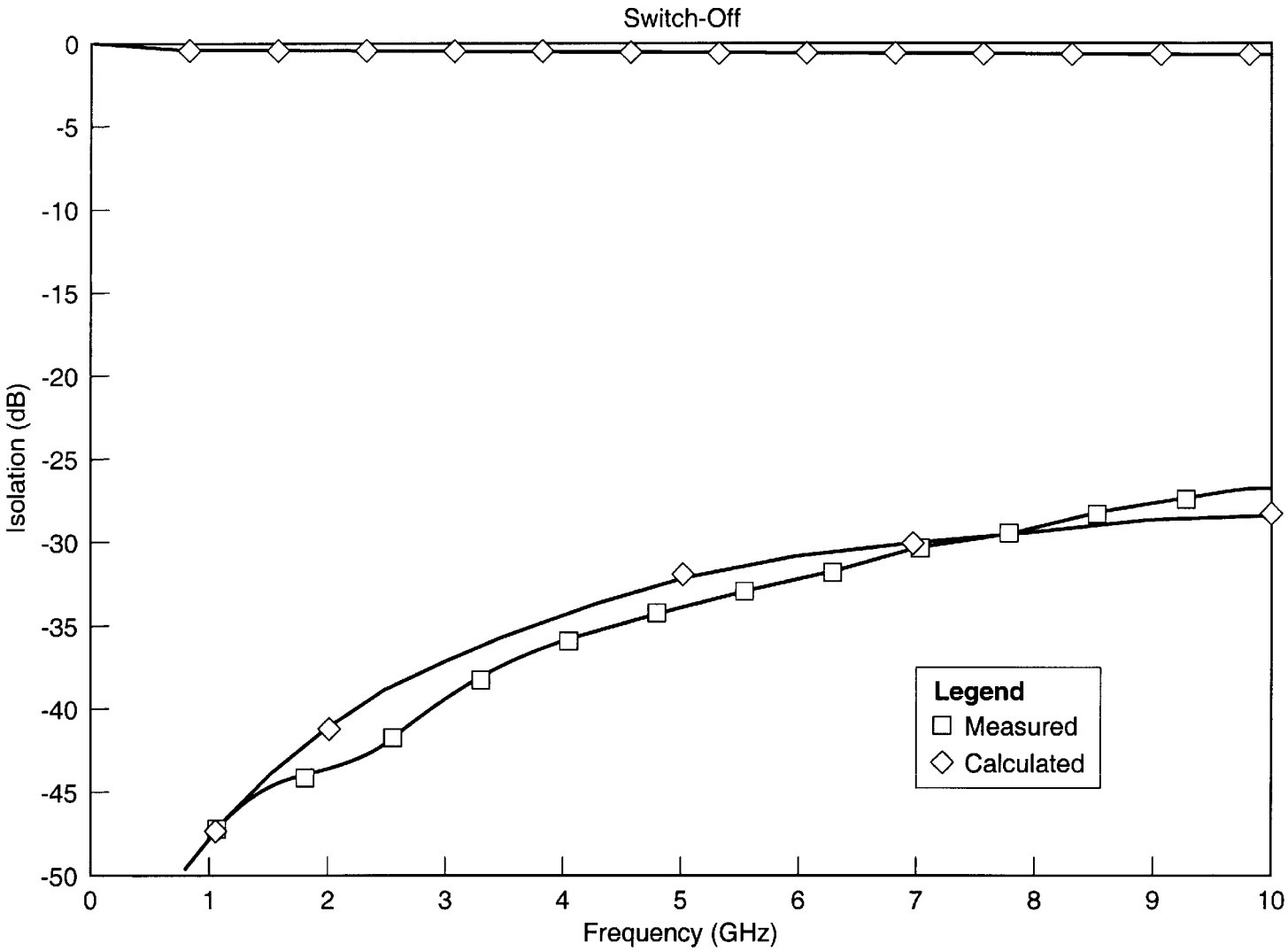
FIG. 9 is a graphical illustration of the isolation in dB as a function of frequency in GHz of an exemplary switch with the switch in an OFF position.

For a switch, for example, as illustrated in FIGS.2, 3*a* and 3*b*, the insertion loss, return loss, and isolation up to 10 GHz is illustrated in FIGS. 8 and 9. These figures show that the switch 50 exhibits relatively low insertion loss and a relatively high return loss at about 2 GHz and an isolation of about 45 db. In order to improve the isolation, two switches can be connected in series provide isolation up to 90 db.

Figure 10A:
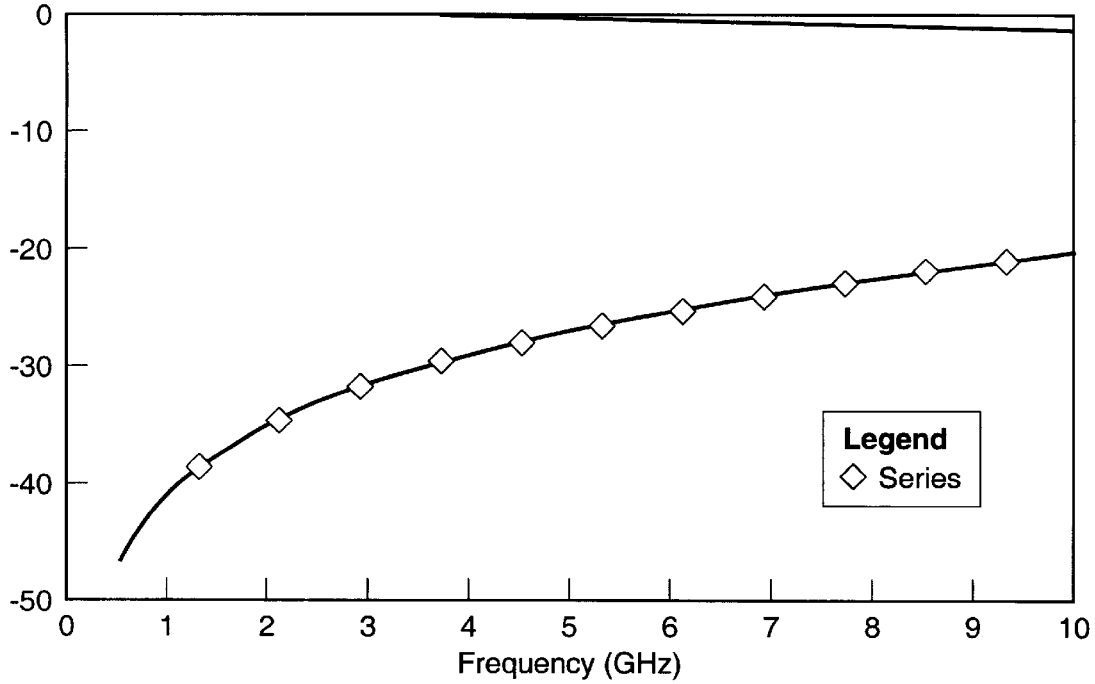
FIGS. 10*a* and 10*b* are graphical illustrations of the isolation the switches illustrated in FIGS. 3 and 5, respectively.
Figure 10B:
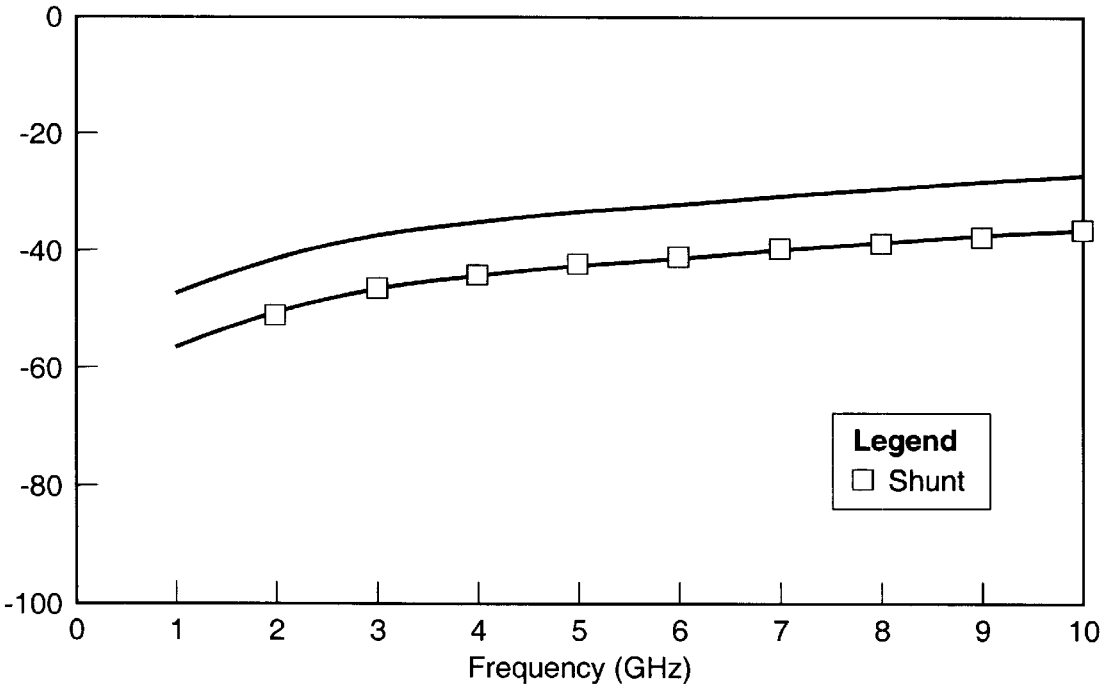

The isolation of the two switches 50 and 70 is compared in FIGS. 10*a* and 10*b*, respectively. Since the switch 70 is configured as a shorting bar switch with one end of the beam used to short the input of the output transmission line, by designing the gap spacing and providing for adequate width of the transmission lines, the switch 70 can provide 50 db isolation at 2 GHz as shown in FIG. 10*b* while two switches in series can provide up to 100 dB isolation.

Figure 6:
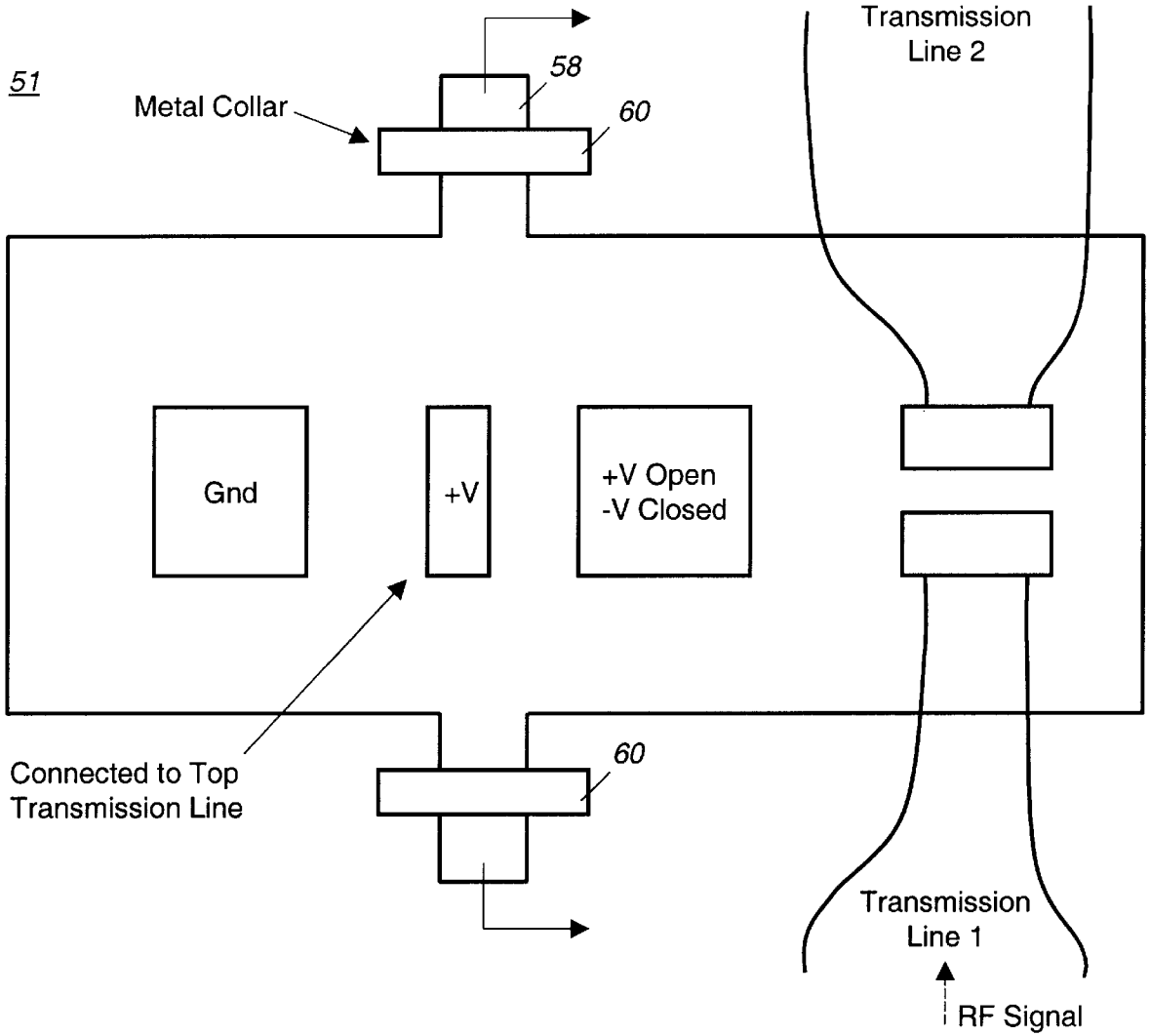
FIG. 6 is a plan view of the alternate embodiment of the RF switch shown in FIG. 5 in accordance with the present invention.
Figure 7:
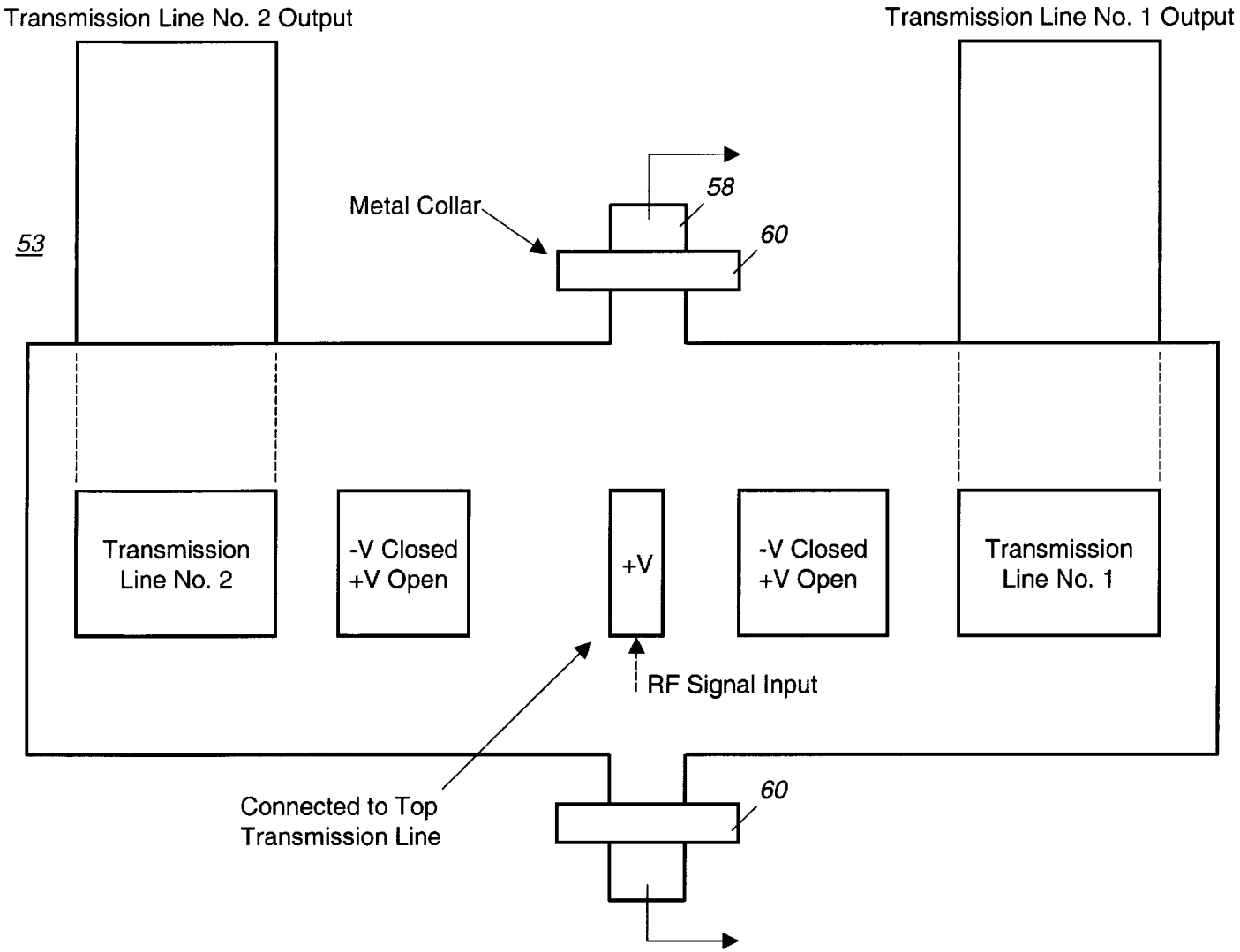
FIG. 7 is a plan view of another alternate embodiment of the RF switch shown in FIG. 3 in accordance with the present invention.

Alternate configurations of the switches 50 and 70, are illustrated in FIGS. 6 and 7. In the embodiment illustrated in FIG. 6, a switch 51 is used to connect a through transmission line, while a switch 53 (FIG. 7) is used to connect two parallel spaced apart transmission lines.

The switch 51 has two switch states; open and closed. In an open state the two transmission lines are disconnected while in a closed state the two transmission lines are connected.

Referring to FIG. 7, the switch 53 has three switch states; all open, one closed or both closed. In this embodiment, the beam connecting the two transmission lines is able to move in a linear vertical direction as well as pivot about the pin in order to connect or disconnect one or both of the transmission lines from the RF signal, coupled to the beam.

FIGS. 12*a*–15*c* illustrate the step-by-step details for fabricating a MEMS in accordance with the present invention.

As mentioned above, the MEMS in accordance with the present invention may be integrated with a microwave monolithic integrated circuit (MMIC) 53 and formed on a polymer substrate 52 directly thereon. Alternatively, the MEMS may be fabricated as a stand-alone device.

Figure 12A:
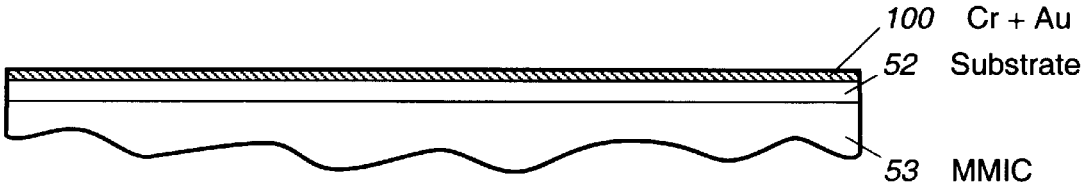
FIGS. 12*a*–15*c* are drawings illustrating the step by step fabrication process for the switch in accordance with the present invention.

Referring to FIG. 12*a*, a layer of conductor metal 100 is formed on the substrate layer 52. The conductor metal may be deposited by evaporating, for example, 300 Å chromium (Cr) and 2,000 Å of gold (Au) directly on the substrate 52.

Figure 12B:
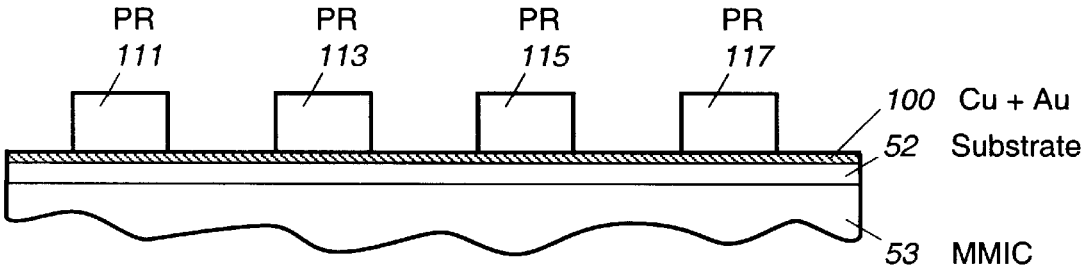
Figure 12C:
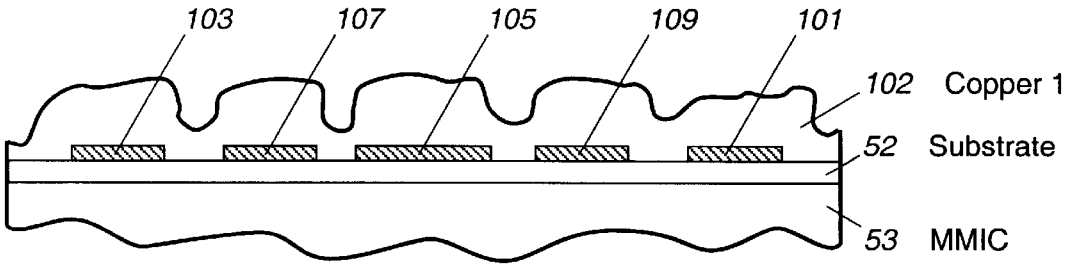

The conductor metal layer 100 is masked and patterned by conventional photolithography techniques to form various configurations of contacts and field plates. An exemplary configuration of contacts which includes the contacts 101 and 103, a pivot contact 105, and a pair of field plates 107 and 109 is shown in FIG. 12*c*. As shown, the contacts 101 and 105 as well as the field plates 107 and 109 are electrically coupled to a plurality of input/output ports 111, 113, 115 and 117 (FIG. 12*b*). The contact 103 is directly coupled to the contact 105. Other configurations are possible.

The photoresist is spun onto the conductor metal layer 100 and exposed by way of the mask to define the contacts, conductors and field plates, for example, as illustrated in FIGS. 3*b*and 5*b*. Once the conductor pattern is defined by the photolithic techniques, the conductor metal layer 100 is etched, for example, by wet etching, to form the conductors, contacts and field plates.

Figure 12D:
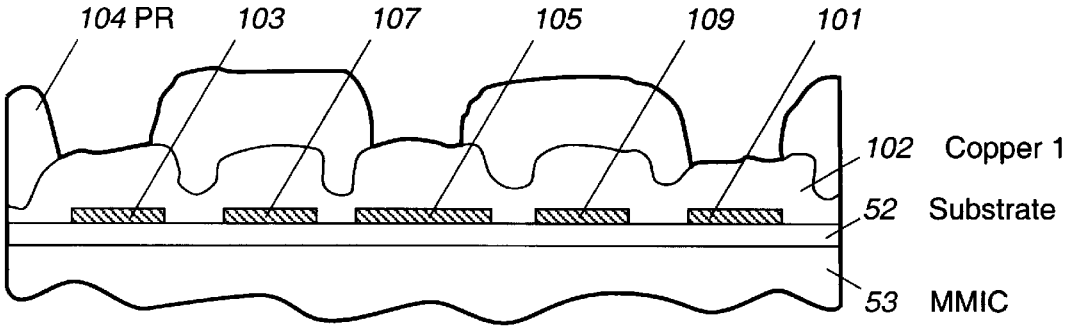
Figure 12E:
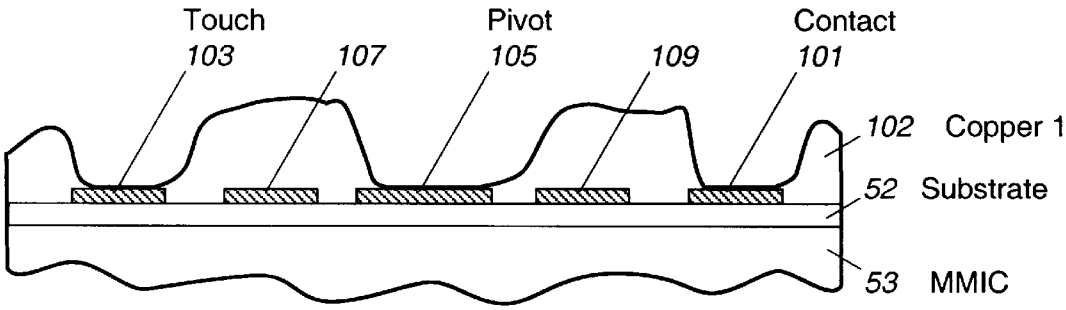

As discussed above, the MEMS is formed in a teeter totter configuration which includes a metal beam, a pivot and one or more pins which are rotatably secured to the substrate with collars. The pivot as well as the collars require the use of a number of spacers. As such, a layer of copper (Cu) 102, for example, 1.2–1.5 $\mu$m, is formed on top of the conductors for example, by evaporation as shown in FIG. 12*c*. The copper layer 102 (identified as copper 1 in FIG. 12*c*) is used to form the spacer for the pivot as well as the collar, as will be discussed in more detail below. In particular, as illustrated in FIG. 12*d*, a photoresist layer 104 is spun onto the copper layer 102. The contacts, the pivot, as well as the collar portions are defined by conventional photolithography techniques. After the contacts, collar and pivot are defined, the copper layer 102 is etched, for example, by conventional wet etching, as shown in FIG. 12*e*. In addition, the photoresist layer 104 is also stripped.

Figure 13A:
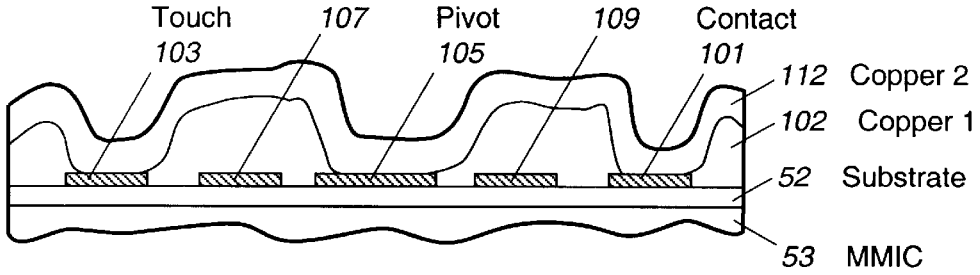

A second spacer is formed as illustrated in FIG. 13*a*. In particular, a second layer of copper (copper 2) 112, for example 1.2 $\mu$m, is formed on top of the structure illustrated in FIG. 12*e*, for example, by evaporation. Once the second layer of copper 112 is deposited, the pivot and collar base is defined as illustrated in FIGS. 13*b* and 13*c*.

Figure 13B:
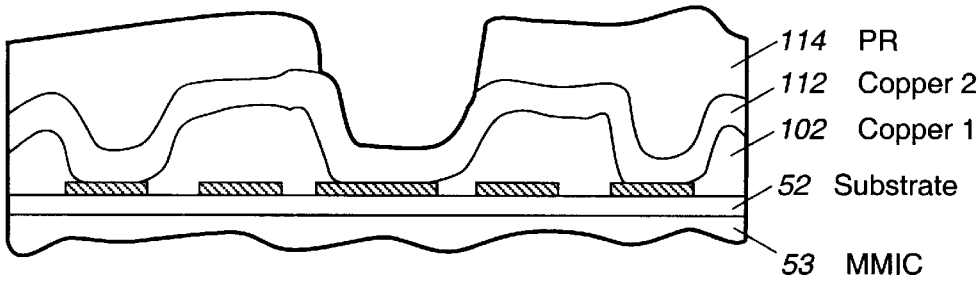
Figure 13C:
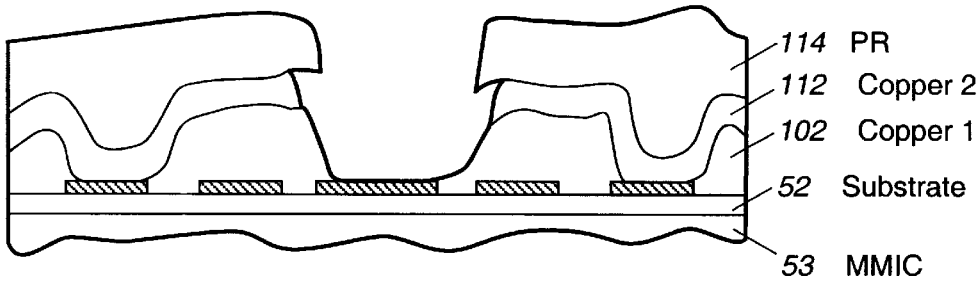

In particular, a photoresist layer 114 is spun on to the copper layer 112 and exposed by conventional photolithigraphic techniques to define the pivot and collar base as illustrated in FIG. 13*b*. Subsequently, as illustrated in FIG. 13*c*, the copper II layer 112 is etched to define the pivot and collar base.

Figure 13D:
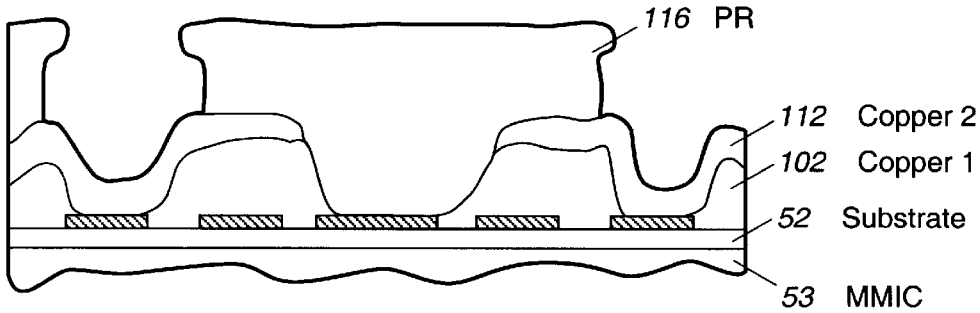
Figure 13E:
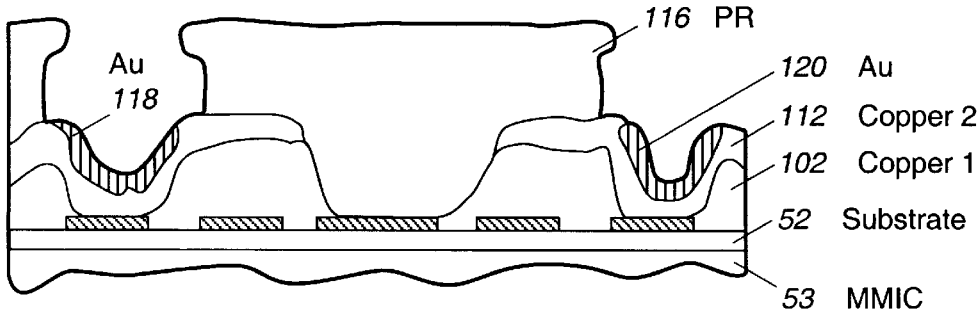

Referring to FIG. 13*d*, the top contacts are formed as illustrated in FIG. 13*d* and 13*e*. In particular, a photoresist layer of, for example, chlorobenzine photoresist 116 is spun onto the structure as illustrated in FIG. 13*d*. The photoresist layer 116 is masked and exposed by conventional photolithography techniques to define a pair of top gold contacts 118 and 120, as illustrated in FIG. 13*e*. In particular, once the contact areas are defined as shown in FIG. 13*d*, 5,000 Å, for example, of gold (Au) is evaporated onto the structure to form the gold contacts 118 and 120.

Figure 13F:
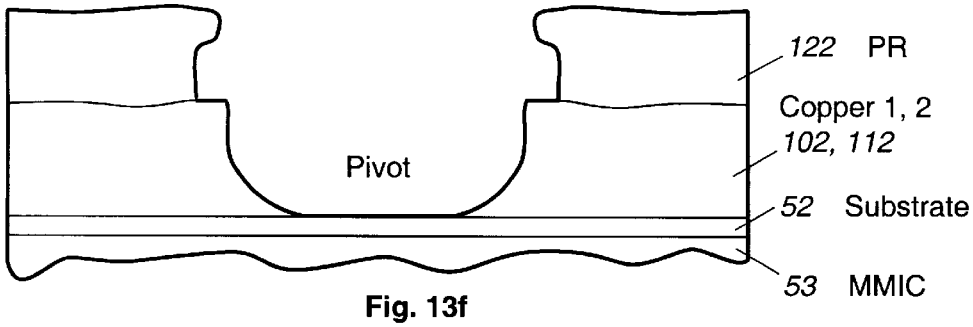
Figure 13G:
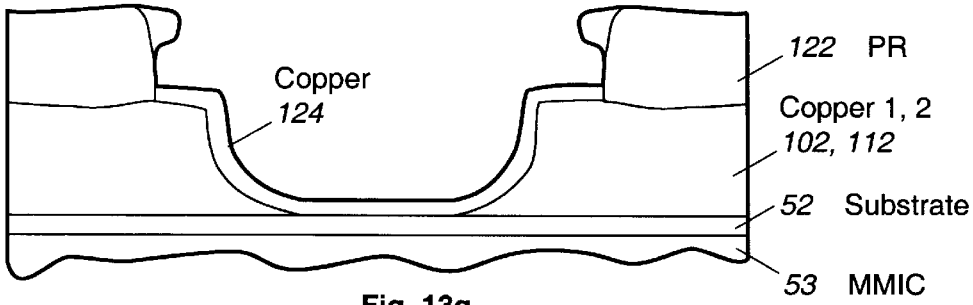

After the gold contacts 118 and 120 are formed, a release copper layer is formed as illustrated in FIGS. 13*f* and 13*g*. In particular, a photoresist layer 122 is spun on to the structure illustrated in FIG. 13*e* and exposed by conventional photolithography techniques to define a release copper layer 124. The release copper layer 124 is deposited, for example, by evaporating 2,000–5,000 Å of copper on the structure illustrated in FIG. 13*f* and lifting off the photoresist. The release copper is removed later in the process to allow the pins and pivot formed thereupon to rotate.

Figure 14A:
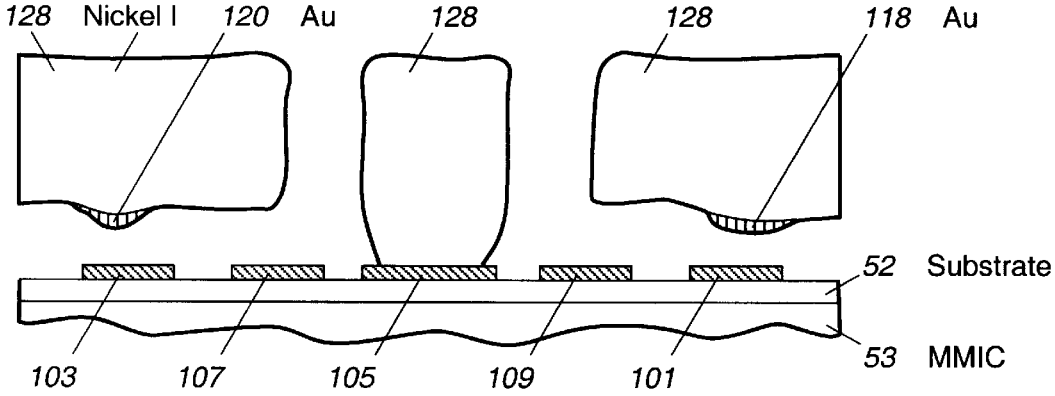

The beam and plates are formed by way of a layer of photoresist (not shown) which is spun onto the structure and patterned by conventional photolithography techniques to define the beam and the field plates. The beam and plates are then formed by plating the structure with, for example, 4 $\mu$m of nickel (Ni), forming a first nickel layer (nickel I) 128 (FIG. 14*a*). Additionally, the photoresist layer mentioned above is stripped.

A cross-section view of the switch after the application of the first nickel layer 128 is illustrated in FIG. 14*a*. As illustrated in FIG. 14*a*, the top contacts 118 and 120 are disposed on the underside of the nickel layer 128, which forms the beam. For simplicity, FIG. 14*a* is shown with the copper layers 102 and 112 removed to illustrate the spacing between the contacts 118 and 120 formed on the under side of the beam and the conductor formed on the substrate 52.

Figure 14B:
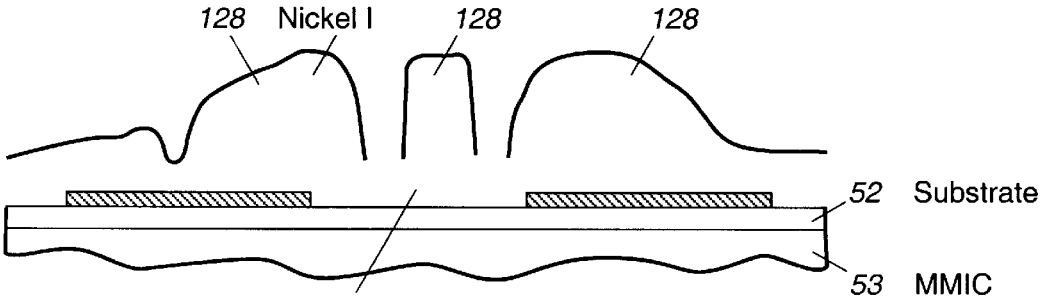

FIG. 14*b* is a cross-section of a portion of the collar.

Figure 15A:
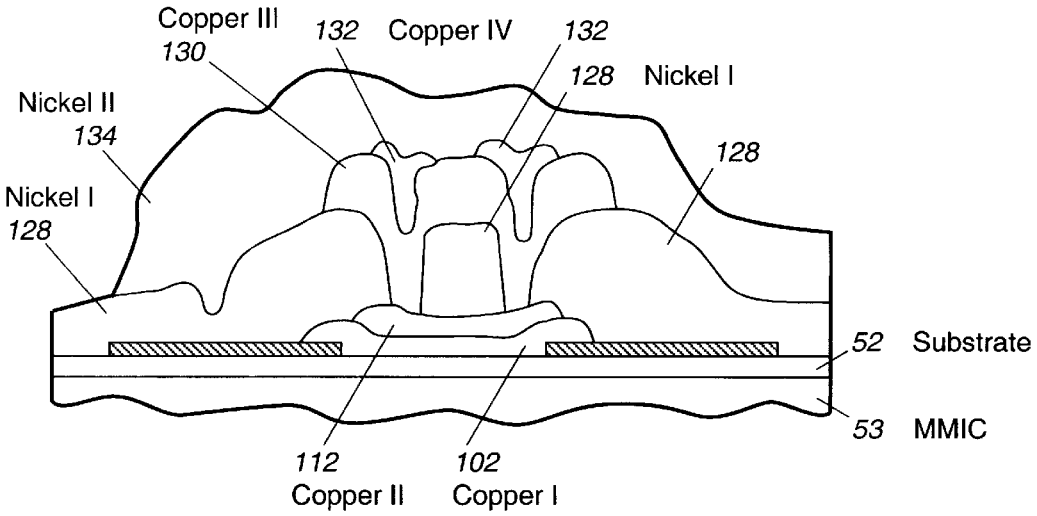
Figure 15B:
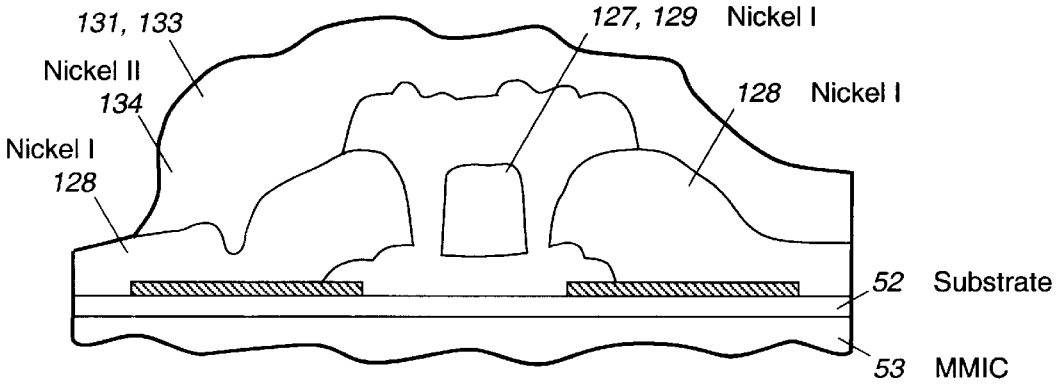

As shown in FIG. 15*b*, a pair of pins 127 and 129 are defined adjacent the pivot. The pins 127 and 129 are formed on top of the copper layer 102.

Figure 14C:
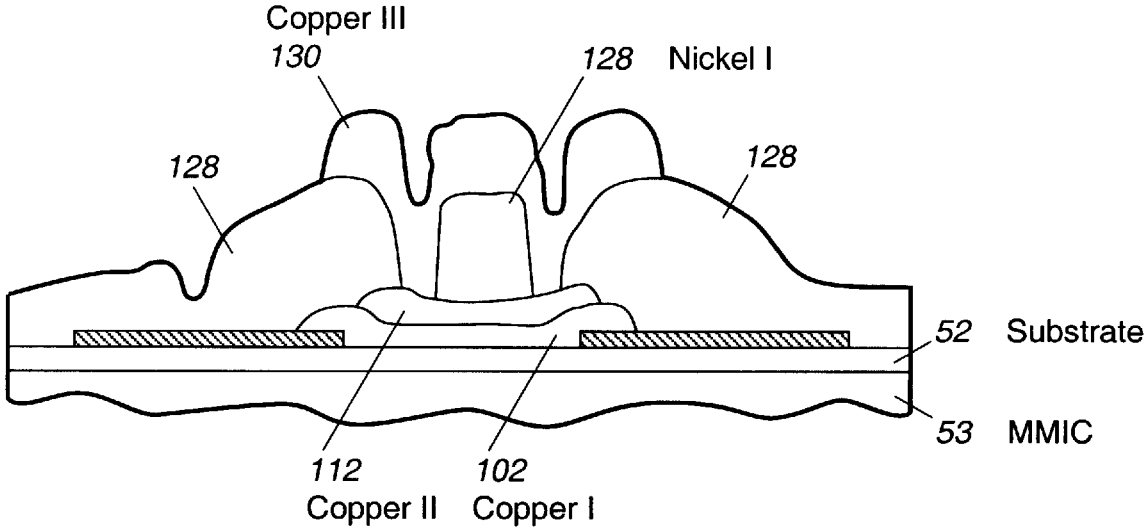
Figure 14D:
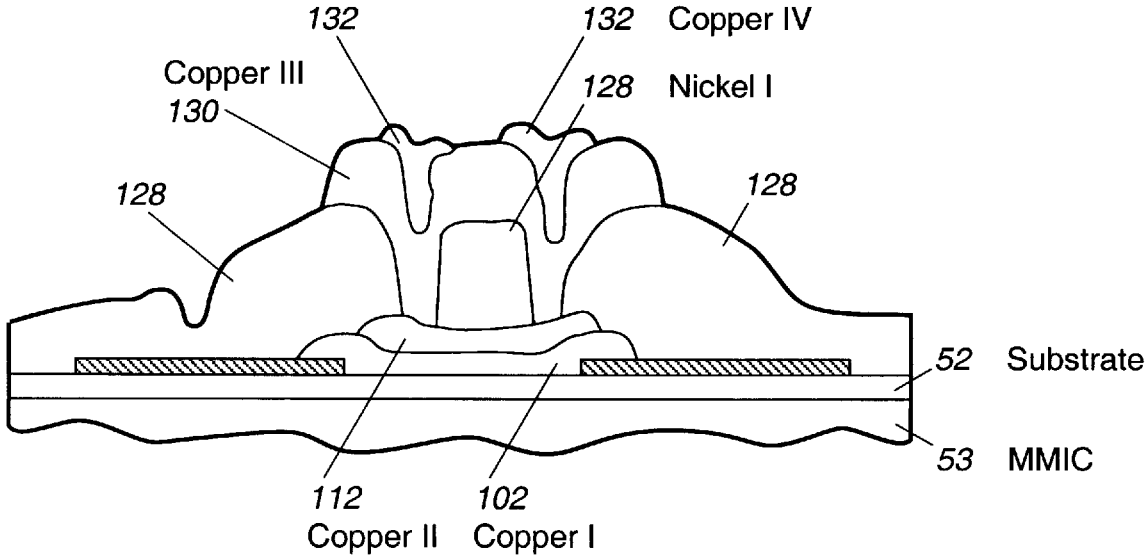

Two collars 131, 133 (FIG. 15*b*) are formed on top of the pins 127, 129 by plating layers of copper (copper III and copper IV) 130 and 132 over the pins 127 and 129 (FIGS. 14*c* and 14*d*). The collars 131, 133 may be patterned by conventional photolithography techniques. The first layer may be formed by plating 5,000 mm of copper Cu while the second layer may be formed by plating 2–3 $\mu$m of copper Cu from the structure.

Figure 15C:
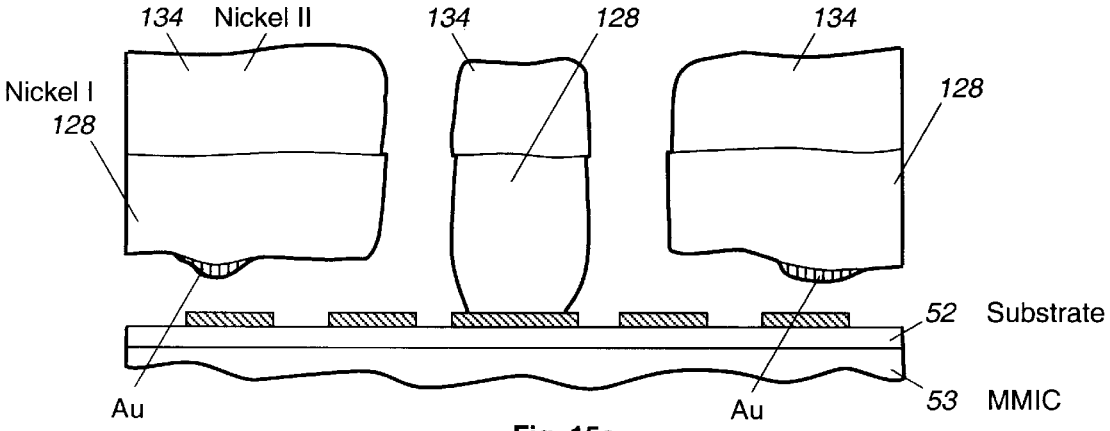

As shown in FIGS. 15*a*–*c*, a second layer of nickel (nickel II) 134 is formed on top of the structure which reinforces the beam and forms the collars 131, 133 as illustrated in FIG. 15*a* for rotably carrying and capturing the pins 127, 129 with respect to the substrate 52. After the collars 131, 133 are formed over the pins 127 and 129, the copper is etched out to yield the structures illustrated in FIGS. 15*b* and 15*c*. Once the copper is etched out the pins, 127 and 129 are free to rotate as shown in FIG. 15*b*. FIG. 15*c* illustrates the pivot after the copper is etched out.

Obviously, many modifications and variations of the present invention are possible in light of the above teachings. Thus, it is to be understood that, within the scope of the appended claims, the invention may be practiced otherwise than as specifically described above.

We claim:

1. An RF switch comprising:

a generally planar substrate;

a pin disposed on said substrate, said pin freely rotatable with respect to said substrate defining a pivot axis generally parallel to the plane of the substrate;

one or more collars secured to said substrate for capturing said pin and enabling said pin to rotate relative to said substrate;

a beam having opposing ends, said beam carried by said pin and therefore adapted to pivot relative to said substrate about said pivot axis, intermediate said opposing ends, to enable said beam to pivot between a first position and a second position, forming a teeter-totter like structure;

one or more pairs of electrical contacts carried by said substrate and said beam; and one or more field plates carried by said substrate for receiving predetermined voltages for creating electrostatic forces to cause said beam to pivot between said first position and said second position as a function of the applied voltage.

2. The RF switch as recited in claim 1, wherein said beam is a rigid beam.

3. The RF switch as recited in claim 1, wherein said beam is formed from all metal.

4. The RF switch as recited in claim 3, wherein said metal is nickel Ni formed by a low temperature electroplating process.

5. The RF switch as recited in claim 1, wherein a pair of electrical contacts is formed on opposing sides of said pin, forming RF output ports.

6. The RF switch as recited in claim 5, wherein a field plate is formed adjacent each pair of said electrical contacts.

7. The RF switch as recited in claim 6, further including a metal contact in contact with said pin forming on RF input port.

8. The RF switch as recited in claim 1, wherein said substrate is a layer of a predetermined polymer, glass, or semiconductor.

9. The RF switch as recited in claim 8, wherein said polymer is polyimide.

10. The RF switch as recited in claim 5, wherein one pair of electrical contacts is used to connect an RF signal to said beam, the other pair of electrical contacts is used to ground said beam.

11. The RF switch as recited in claim 1, wherein said RF switch is monolithically formed.

12. An integrated RF switch comprising:

a monolithic microwave integrated circuit (MMIC) forming a first layer and an RF switch, the RF switch comprising:

a generally planar substrate layer formed above said first layer;

a pin disposed on said substrate, said pin being freely rotatable with resect to said substrate and defining a pivot axis generally parallel to the plane of said substrate layer;

one or more collars secured to said substrate, said one or more collars for capturing said pin and enabling said pin to freely rotate relative to said substrate;

a beam having opposing ends, said beam carried by said pin and therefore adapted to pivot relative to said substrate about said pivot axis, intermediate said opposing ends, to enable said beam to pivot between a first position and a second position forming a teeter-totter like structure;

one or more pairs of electrical contacts carried by said substrate layer and said beam; and one or more field plates carried by said substrate layer for receiving predetermined voltages for creating electrostatic forces to cause said beam to pivot between said first position and said second position as a function of the applied voltage.

13. The integrated RF switch as recited in claim 12, further including vias formed in said substrate layer for enabling connections between said MMIC and said RF switch.

14. The integrated RF switch as recited in claim 12, wherein said MMIC includes circuitry formed from heterojunction bipolar transistors (HBT).

15. The integrated RF switch as recited in claim 12, wherein said MMIC includes circuitry from high electron mobility transistors (HEMT).

16. The integrated RF switch as recited in claim 12, wherein said beam is rigid.

17. The integrated RF switch as recited in claim 12, wherein said beam is formed from all metal.

18. The integrated RF switch as recited in claim 12, wherein said substrate layer is polyimide.

19. A method for forming a micro electro-mechanical switch (MEMS) comprising the steps of:

(a) providing a generally planar substrate;

(b) forming contacts on said substrate;

(c) forming a pin on said substrate, said pin freely rotatable with respect to said substrate defining a pivot axis generally parallel to the plane of said substrate;

(d) forming one or more collars attached to said substrate for capturing said pin;

(e) forming a beam having opposing ends, said beam carried by said pin and therefore adapted to pivot about said pivot axis, intermediate said opposing ends, to enable said beam to rotate in a plane generally perpendicular to said substrate forming a teeter-totter structure;

(f) forming contacts on said beam adapted to mate with said contacts on said substrate; and (g) forming field plates on said substrate for receiving predetermined voltages for creating electrostatic forces to cause said beam to rotate relative to said substrate.

20. The MEMS as recited in claim 19, wherein said rotatable beam is formed with an extending pin.

21. The MEMS as recited in claim 19, wherein said MEMS is adapted to form on top of an existing monolithic microwave integrated circuit.

22. The MEMS as recited in claim 19, wherein said substrate is a polymer.

* * * * *